US006112394A

United States Patent [19]

Seidel et al.

[11] Patent Number: 6,112,394

[45] Date of Patent: Sep. 5, 2000

[54] METHOD OF CONTINUOUSLY CASTING AND FINISH-ROLLING A CAST STRAND WITHIN A PREDETERMINED FINISHED WIDTH TOLERANCE

[75] Inventors: Jürgen Seidel, Kreuztal; Karl-Ernst Hensger, Düsseldorf, both of Germany

[73] Assignee: SMS Schloemann-Siemag Aktiengesellschaft, Düsseldorf, Germany

[21] Appl. No.: 09/281,486

[22] Filed: Mar. 30, 1999

[30] Foreign Application Priority Data

Mar. 31, 1998 [DE] Germany ..... 198 14 222

[51] Int. Cl.[7] ..... B23Q 17/00

[52] U.S. Cl. ..... 29/407.01; 29/527.5; 29/527.7; 700/145; 700/154; 164/452; 164/436

[58] Field of Search ..... 29/527.5, 527.7, 29/407.01; 164/476, 452, 154.5, 436, 491; 700/145, 146, 148, 155, 154, 206, 150

[56] References Cited

U.S. PATENT DOCUMENTS

| | | | |
|---|---|---|---|
| 4,105,059 | 8/1978 | Ohnishi | 164/4 |
| 4,110,824 | 8/1978 | Halsey et al. | 700/151 |
| 4,577,277 | 3/1986 | Kamei et al. | 700/146 |
| 5,205,345 | 4/1993 | McClellan | 164/452 |
| 5,377,119 | 12/1994 | Backer | 700/146 |
| 5,455,773 | 10/1995 | Frey | 700/146 |

FOREIGN PATENT DOCUMENTS

| | | |
|---|---|---|
| 0149734 | 7/1985 | European Pat. Off. . |
| 3501422 | 8/1985 | Germany . |

*Primary Examiner*—Irene Cuda
*Assistant Examiner*—Anthony L. Green
*Attorney, Agent, or Firm*—Friedrich Kueffner

[57] ABSTRACT

A method of continuously casting and finish-rolling a cast slab within a predetermined finished width tolerance, wherein for the cast slab and any subsequent slab an adjustment of the mold position is carried out particularly in accordance with different rolling conditions for achieving the predetermined finished width within a tolerance strip, initially a preadjustment of the mold position is carried out, inter alia, while considering the extreme strip dimensions of the planned production program, a computation for the optimum use for the mold adjusting units and the adjusting units of the finishing train is carried out for each cast slab and any subsequent slab, and, with an existing entering width of the cast slab into the finishing train, a reoptimization of the finished width by means of the adjusting units of the finishing train is carried out.

16 Claims, 3 Drawing Sheets

METHOD OF CONTINUOUSLY CASTING AND FINISH-ROLLING A CAST STRAND WITHIN A PREDETERMINED FINISHED WIDTH TOLERANCE

BACKGROUND OF THE INVENTION

1. Field of the Invention

The present invention relates to a method of continuously casting and finish-rolling a cast slab within a predetermined finished width tolerance, wherein for the cast slab and any subsequent slab an adjustment of the mold position is carried out particularly in accordance with different rolling conditions.

2. Description of the Related Art

The technology of casting thin slabs which has been used to great advantage makes possible the continuous casting with continuous casting sizes of between about 30 and 100 mm thickness and 800 to 2,200 mm width, and a preferably direct rolling in a rolling train with deformation work which is significantly reduced as compared to conventional production methods, wherein the length of the production chain from the crude steel to the rolled product is significantly reduced.

In this technology, increasingly higher demands are made of the width tolerances to be maintained in the finished product.

It is generally known in the art to equip slab molds for adjusting a predetermined slab size with adjustable long side walls and/or short side walls and corresponding mechanical or hydraulic adjusting units.

This prior art technology is disclosed in European application 0 149 734. This European application shows a mold for continuously casting thin slabs with cooled long side walls and short side walls, wherein the long side walls form a funnel-shaped pouring area which is limited to only a portion of the height of the mold, wherein the pouring area is reduced toward the short sides and in the casting direction to the sides of the cast slab. The long side walls extend laterally of the funnel-shaped pouring area parallel to each other and at a distance corresponding to the slab thickness up to the respective short side wall so as to form a parallel area starting at the pouring area. The short side walls are adjustable in the parallel area of the long side walls. The adjustment of, for example, the width of thin slabs is also known from DE 35 01 422 C2.

SUMMARY OF THE INVENTION

Starting from the prior art discussed above, it is the object of the present invention to further develop a method of the above-described type, so that in continuously cast and rolled thin slabs it is possible to maintain narrow width tolerances in the finished slab.

In accordance with the present invention, for achieving the predetermined finished width within a tolerance range, initially a preadjustment of the mold position is carried out, while considering the extreme slab dimensions of the planned production program, a computation for the optimum use for the mold adjusting units and the adjusting units of the finishing train is carried out for each cast slab and any subsequent slab, and with an existing entering width of the cast slab into the finishing train, a reoptimization of the finished width by means of the adjusting units of the finishing train is carried out.

The method according to the present invention of optimizing the width of a continuously cast thin slab advantageously includes the following steps:

a) producing the slab width or determining positions of the mold adjusting units and possibly also the preliminary slab width of a conventional train, and b) reoptimizing the finishing train adjusting units at an existing entering width.

These steps are carried out in thin slab finishing trains as well as in conventional finishing trains. The method of width optimization according to the present invention can be used in a multiple-stand plant as well as in a reversing stand with several passes.

In accordance with a possible manner of operating the method according to the invention, the adjusting units of the finishing train are relieved and the finished width is adjusted for each individual slab by a preadjustment of the mold adjusting unit.

A further development of the method provides that the adjusting units of the mold are operated in accordance with the desired adjustment determined by computation prior to casting of the subsequent slab, and that the computation of the finishing train adjusting units is based on a pass schedule model, a slab shape model and a width model, and, prior to rolling of the subsequent slab, the desired adjustment of the finishing train adjusting units determined by computation is carried out.

In accordance with another application for the optimization of the slab width in accordance with the present invention, preferably the finishing train adjusting units are utilized for the width adjustment.

In order to avoid a change of the mold position for superior reasons, for example, the surface quality or the casting speed, or to minimize the adjusting distances and adjusting frequency, the effective parameters of the finishing train are adjusted with respect to the width in such a way that the desired (frequently equal) finished slab width is produced within the tolerance (see the explanations concerning FIG. 3 below).

In accordance with a further development of the method, the width preadjustment for the mold adjusting units and the finishing train adjusting units are carried out in such a way that for each rolled strip is approximately the middle of the medium tolerance range of the finishing width of the rolled slab is achieved.

In addition, the method according to the present invention provides, that prior to the production of a new cast slab, a slab shape computation and a pass schedule computation as well as the width model are initiated, and subsequently an appropriate preset of the mold adjusting units is carried out, and subsequently the effective width of the finished rolled slab is measured, and the result is used to form the basis of any necessary correction of the width model and, thus, the computation of the finished train adjusting units.

The production control system according to the present invention provides the advantage that a width preadjustment is carried out at the mold and simultaneously the adjusting ranges in the rolling train are made smaller.

Another further development of the method provides that, for an optimum use of the adjusting units of the mold and the finishing train and for achieving a high accuracy, a width model is used as the basis for a preset adjustment which takes in consideration at least the foiling influences:

width change between mold and caster outlet;

temperature shrinkage from the caster to the finished strip;

strip tensions within the finishing train;

contour changes of the slab shape up to the finished strip shape;

flatness condition of the slab between the finishing stands;

natural widening of the slab, thickness of the slab;

rolling speed, rolling temperature;

material quality of the slab;

upsetting reduction;

slab or preliminary slab contour (as a measurement or computation value).

The method according to the invention further provides that an adaption/correction coefficient is obtained by comparing the measured width of the cast slab to the computed slab width and is used for correcting the width model.

Also, a width error measured in the caster area can be utilized in the width model of the finishing train.

Moreover, in the method according to the invention it is further provided that, for fine tuning the finished width of the rolled strip in the finishing train, the following effective parameters are taken into consideration in the stated order of preference and are used in such a way that the difference between the computed width and the target width is minimized:

change of the reduction distribution in the train;

change of the target profile within the framework of the profile tolerance slab;

change of the tension between the stands;

use of an upsetting unit;

change of the number of active stands or of the number of passes.

Finally, the method according to the present invention further provides that, for expanding the tolerance range for the positions of the mold adjusting units, the minimum/maximum adjusting ranges of the finishing train adjusting units are determined in such a way that a change of the mold adjusting unit positions is only carried out after reaching minimum or maximum adjusting ranges of the finishing train adjusting units.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
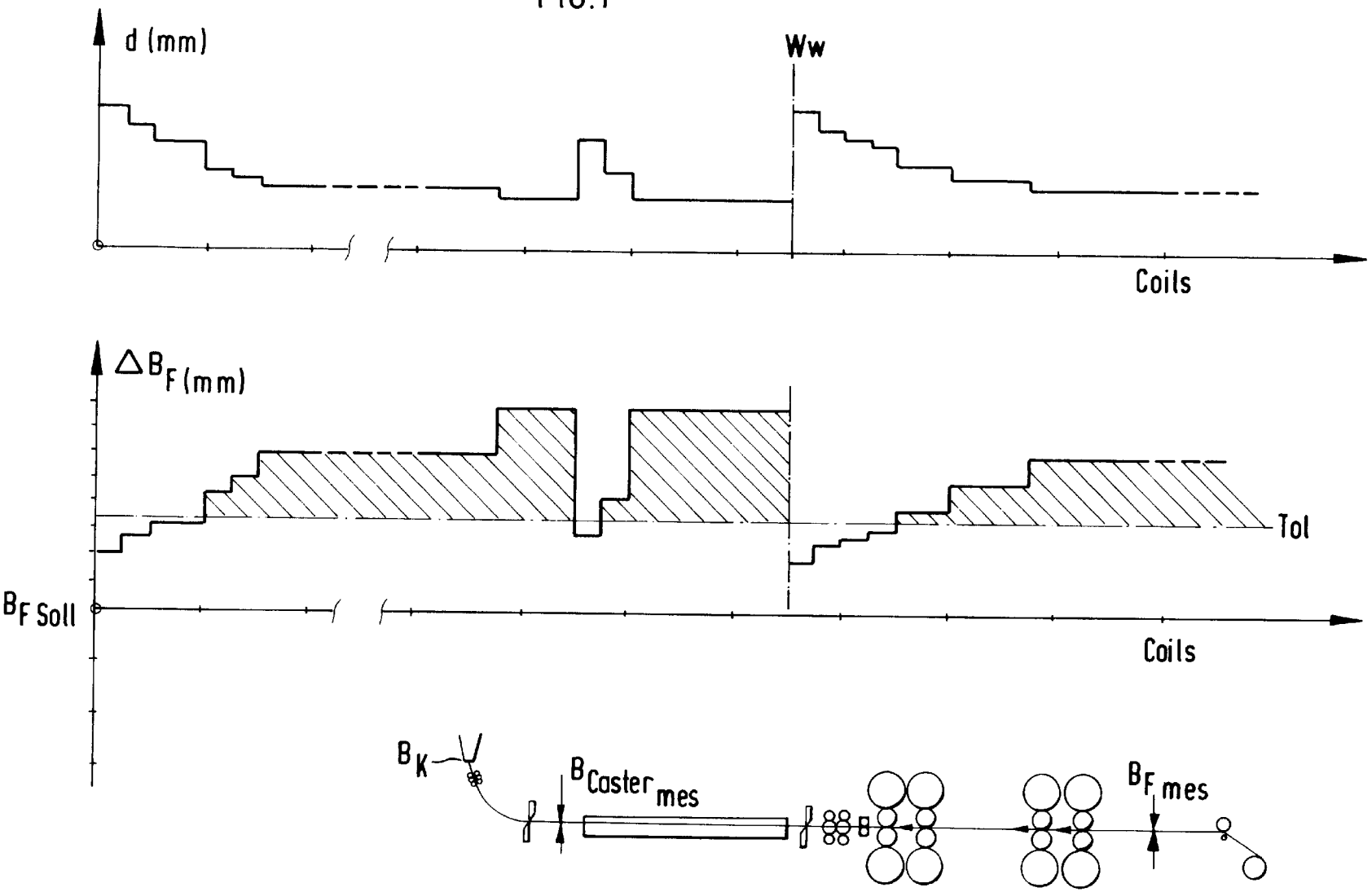
FIG. 1 is a diagram showing a rolling program with a number of coils of different slab thickness and the resulting finished width with constant-adjusted mold position, illustrated in connection with a conventional CSP plant.

In order to make possible a better understanding of the invention, initially the reference characters used in FIGS. 1–3 of the drawing are explained as follows:

FIG. 1

$d_F$ (mm)=finished slab thickness $\Delta BF$ (mm)=width deviation

Tol=maximum tolerance width of the rolled slab $B_{FSoll}$=desired finished width of the rolled slab Ww=roll exchange

FIG. 2

$B_K$=mold width/preliminary slab width (head/end)

$B_F$=effective finished width of the rolled slab $B_{F1-n}$=slab width between the stands $B_{BR}$=measured slab width ΔW=change of the effective parameters of the finishing train

10=pass schedule model

11=shape model

12=width model (C=caster; F=finishing train)

13=adaption caster width

14=adaption slab width

15=position lateral guide means

16=measured finished width of the rolled slab

FIG. 3

$B_{K1}$; $B_{K2}$=mold width without optimization $B_{Kopt}$=mold width with optimization $W_1$; $W_2$=adjusting range of the acting elements of the finishing train St=influence of the adjusting units $B_{F1}$; $B_{F2}$=finished slab width without optimization $B'_{F1}$; $B'_{F2}$=finished slab width with optimization $B_Z$=target width ΔB=width tolerance of the rolled strip $\Delta B_{opt}$=width difference of the mold between the positions with and without optimization $B_M$=average value between the maximum possible finished width $B_{F2}$ and the minimum possible finished width $B_{F1}$ Index 1=finished product 1

Index 2=finished product 2

The diagram lines in the upper portion of FIG. 1 show a pass schedule with a greater number of coils, wherein the thicknesses of the products of individual coils vary between 1 and 3 mm.

The diagram lines in the lower portion of FIG. 1 show that significantly different slab widths occur when the position of the mold is kept constant. The hatched areas below the slab width line indicate the excess width produced when the rolled slab has a small thickness. This shows that, with increasing thickness of a rolled slab, the width increase of the slab decreases superproportionally. Consequently, this means that for each finished slab it is necessary to carry out a computation of the necessary mold width, wherein this has to be done for the corresponding instantaneously cast slab or for the existing slab. A width adjustment of the model from one slab to another slab is required, as can be seen from the dependency between the slab thickness and the width increase from the diagrams of FIG. 1, in order to stay, with the width of a slab rolled out to a thickness, for example, 1 mm, within the tolerance width Tol, i.e. below the hatched area.

Figure 2:
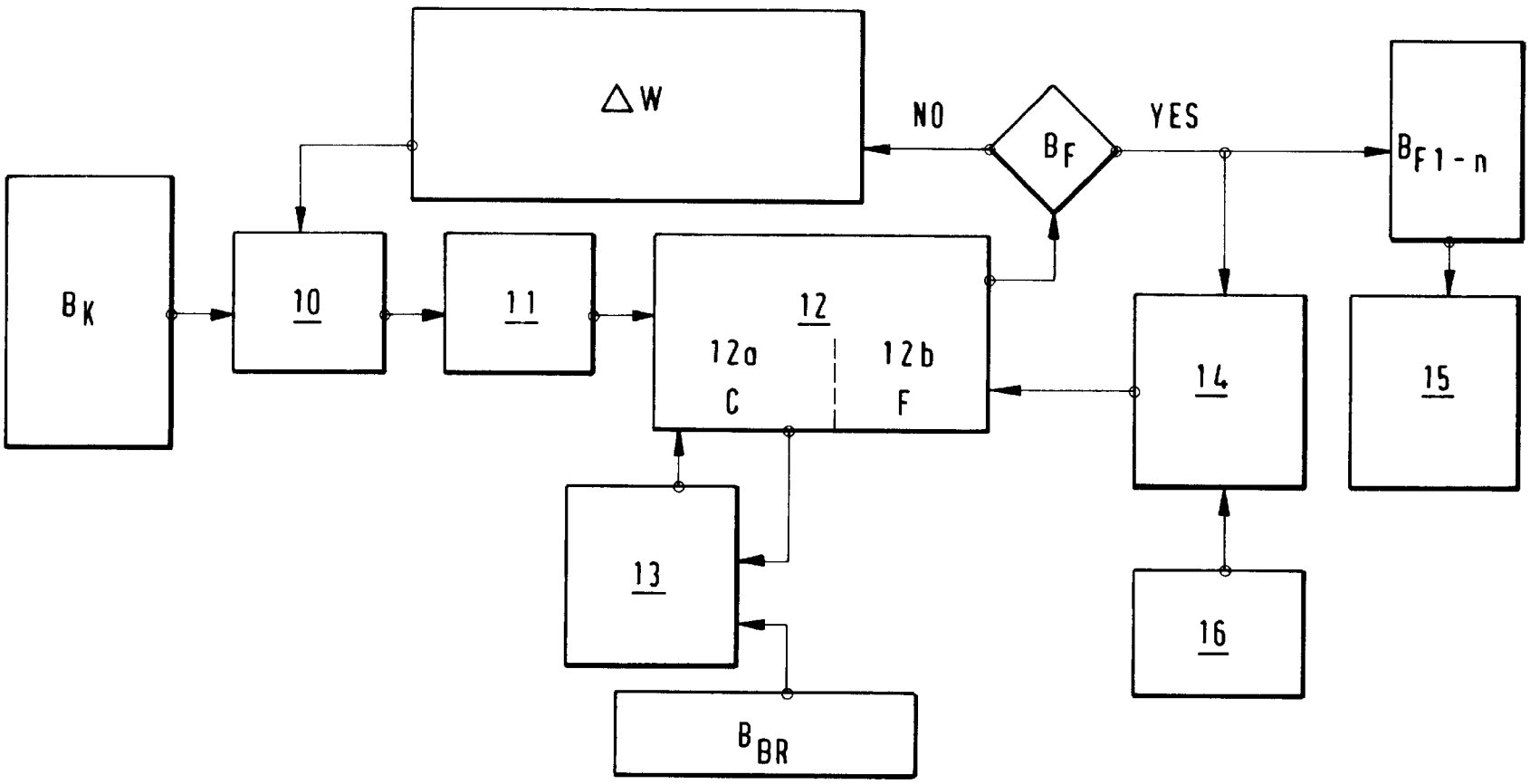
FIG. 2 is a diagram showing a computation model for determining and fine tuning the slab width.

As shown by the flow chart of FIG. 2, an optimization task for the finished slab width resides in preferably using the finishing train adjusting units for the width adjustment. In order to minimize in the mold the frequency of the adjustment of the mold adjusting units or to prevent the adjustment thereof, the effective parameters ΔW of the finishing train are used in such a way that the desired finished slab width is maintained with the predetermined tolerance.

When carrying out the optimization, the maximum permissible slab dimensions of a planned production program are considered and the effective parameters ΔW of the finishing train are utilized to achieve a widening or a constriction. When the entering width $B_{BR}$ is available, the finishing train effective parameters ΔW are used in accordance with the flow chart of FIG. 2 for the slab width corresponding to the claimed order of preference for fine tuning in such a way that the difference between the computed finished slab width and the target width is minimized taking in consideration the plant and material limits.

Starting from a presetting of a standard finishing train, the width of the rolled slab is examined as to whether it is within the permissible range. If it is the case, no iteration of the optimization measures takes place. If it is not the case, the finishing train parameters are changed iteratively, i.e., step by step. After determining the change, another initiation of the finishing train adjustment composed of pass schedule model 10, shape model 11 and widening model 12 takes place, wherein this is true for the width change 12*a* at the caster C as well as for the width change 12*b* in the finishing train F. This iteration loop is initiated as many times as it takes until the change possibilities of the finishing train effective parameters ΔW are exhausted. The reference character $B_{F1-n}$ indicates the slab widths between the individual stands of the finishing train. The flow chart further shows that an adaption value 13 is obtained by comparing the measured width of the cast slab $B_{BR}$ with the computed slab width 12*a*. The measured slab width 16 is also used in comparison to the computed slab width 14 for a correction value and is superimposed on the widening model 12. When reaching the effective finished width $B_F$, the iteration for the change of the effective parameters of the finishing train is concluded and the correct finished product does not require any further corrections.

Figure 3:
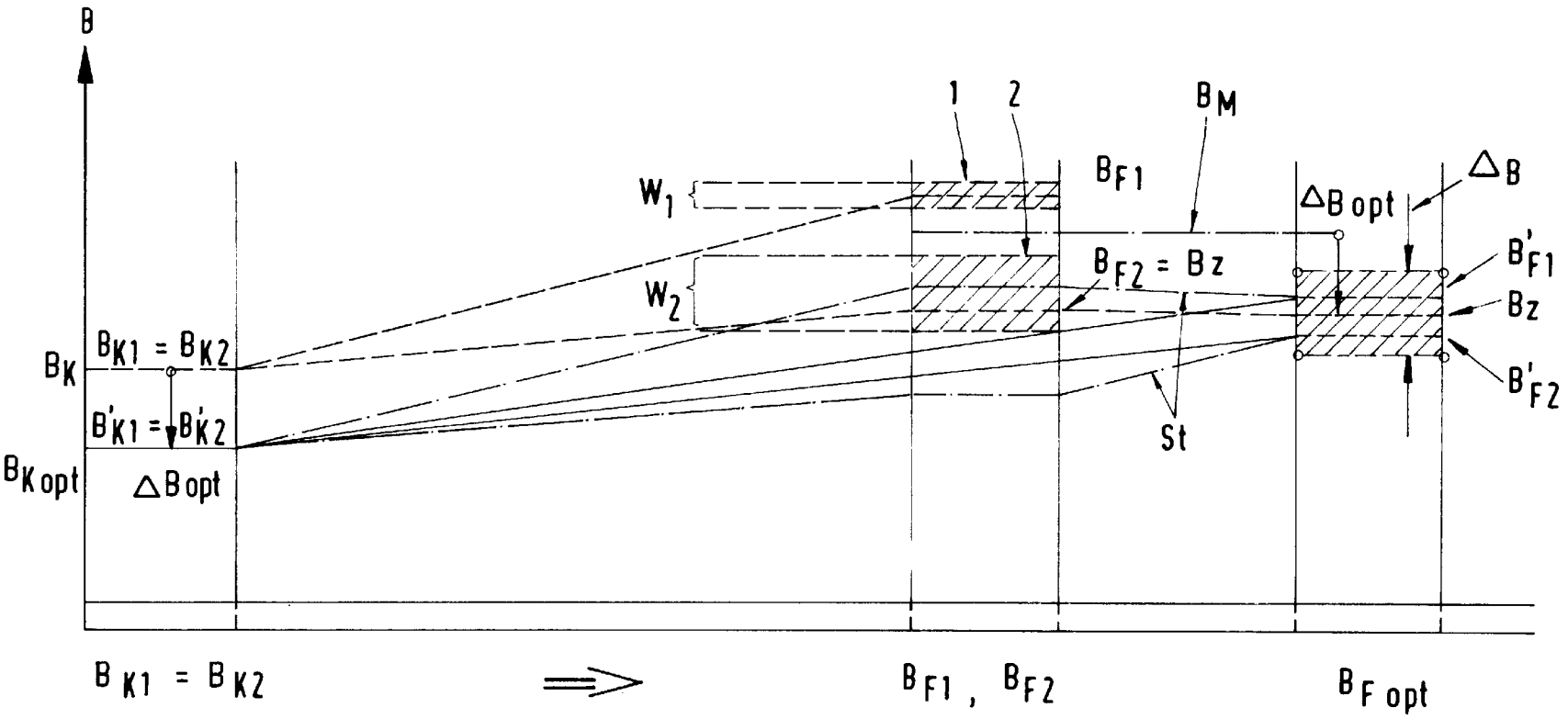
FIG. 3 is a diagram showing the same mold width for different finished products with and without optimization method.

FIG. 3 shows the manner of operation when determining the optimum mold width with the goal of selecting as much as possible the same mold positions for the planned production spectrum of a rolling program.

To illustrate this, FIG. 3 shows diagram lines of equal mold widths for different finished products with and without optimization. The broken lines show finished slab widths when using the standard manner of operation, i.e., without mold width optimization and without utilization of the finishing train adjusting units. The solid lines show finished slab widths with mold width optimization and with utilization of the finishing train adjusting units.

When the mold width $B_K$ is selected in such a way that the slab width $B_{F2}$ of the finished product 2 is within the hatched tolerance area or is equal to the target width $B_Z$, frequently excess width $B_{F1}$ result for the finished product 1 with the same mold width.

In a first step, the effective width ranges $W_1$ ,$W_2$ of the finishing train adjusting units are determined for both finished products 2 or 1. In the second step, the average value $B_M$ between the maximum possible finished width $BF_2$ and the minimum possible finished width $B_{F1}$ is determined.

The difference $\Delta B_{opt}$ between the width $B_M$ and the target width $B_Z$ results in the optimized mold width $B_{Kopt}=B_K-\Delta B_{opt}$ in order to reach for products of the production program the hatched width tolerance window $\Delta_B$.

Starting from the optimized mold width $B_{Kopt}$ ($B'_{K1}=B'_{K2}$), by utilizing the finishing train adjusting units the optimum width $B'_{F1}$; $B'_{F2}$, which are both located within the width tolerance window $\Delta_B$, are obtained. If the finished width $B'_{F2}$ is below the minimum width tolerance limit, i.e., in the impermissible range, the mold width must be corrected by this value.

For determining the required mold position, the model components according to FIG. 2, i.e., pass schedule model 10 contour model 11 width model 12 algorithm for changing the finishing train effective parameters ΔW are used in accordance with the flow chart of FIG. 2 in the claimed order of preference.

The invention is not limited by the embodiments described above which are presented as examples only but can be modified in various ways within the scope of protection defined by the appended patent claims.

We claim:

1. A method of continuously casting and finish-rolling a cast slab within a predetermined finished width tolerance, wherein for the cast slab and any subsequent slab an adjustment of a mold position is carried out by mold adjusting units in accordance with different rolling conditions, the method comprising for achieving a predetermined finished width of the rolled slab within a tolerance range, initially carrying out a preadjustment of the positions of the mold adjusting units, while considering extreme slab width dimensions of a planned production program, carrying out a computation for an optimum use of the mold adjusting units and adjusting units of a finishing train for each cast slab and any subsequent slab, and with an existing entering width of the cast slab into the finishing train, carrying out a reoptimization of the finished width by means of the adjusting units of the finishing train.

2. The method according to claim 1, comprising operating the adjusting units of the mold in accordance with a desired adjustment determined by computation prior to casting of a subsequent slab, basing the computation of the finishing train adjusting units on a pass schedule model, a shape model and a width model, and, prior to rolling of the subsequent slab, carrying out the desired adjustment of the finishing train adjusting units as determined by computation.

3. The method according to claim 1, comprising carrying out a width preadjustment of the mold adjusting units and the finishing train adjusting units, such that for each rolled slab is obtained approximately a medium tolerance range of the finished width of the rolled slab.

4. The method according to claim 1, further comprising prior to producing a new cast slab, initiating a slab shape computation and a pass schedule computation as well as a width model, subsequently carrying out a preadjustment of the mold adjusting units, subsequently measuring an effective width of the finished rolled slab, and using the result to form the basis of any necessary correction of the width model and of the computation of the finishing train adjusting units.

5. The method according to claim 4, comprising initially changing the finishing train adjusting units in accordance with a correction value of the preadjustment preferably with unchanged positions of the mold adjusting units.

6. The method according to claim 1, comprising, for using the adjusting units of the mold and the finishing train to achieve a high accuracy, using a width model as a basis for a preset adjustment, utilizing at least the following influences:

width change between mold and caster outlet;

temperature shrinkage from the caster to the finished slab;

slab tensions within the finishing train;

shape changes of the slab shape up to the finished slab shape;

flatness condition of the slab between the finishing stands;

natural widening of the slab, thickness of the slab;

rolling speed, rolling temperature;

material quality of the slab;

upsetting reduction;

slab or preliminary slab shape as a measurement or computation value.

7. The method according to claim 6, comprising obtaining an adaptation/correction coefficient by comparing the measured width of the cast slab with the computed slab width and using the coefficient for correcting the width model.

8. The method according to claim 6, comprising utilizing a width error measured in a caster area in the width model of the finishing train.

9. The method according to claim 1, comprising, for fine tuning the finished width of the rolled slab of the finishing train, taking into consideration the following effective parameters in the stated order of preference and using the parameters such that a difference between the computed width and the target width is minimized:

change of the reduction distribution in the train;

change of the target profile within the framework of the profile tolerance range;

change of the tension between the stands;

use of an upsetting unit;

change of the number of active stands or of the number of passes.

10. The method according to claim 1, comprising, for expanding the tolerance range for the adjustment of the positions of the mold adjusting units, determining minimum/maximum adjusting ranges of the finishing train adjusting units such that a change of the positions of the mold adjusting units is only carried out after reaching minimum or maximum adjusting ranges of the finishing train adjusting units.

11. The method according to claim 1, comprising using the adjusting units of the mold and/or the adjusting units for influencing the width in the finishing train statically or changeably over the slab length.

12. The method according to claim 1, comprising using the method with a thin slab casting machine having at least one immediately following rolling train.

13. The method according to claim 1, comprising using the method in a multiple-stand finishing train.

14. The method according to claim 1, comprising using the method in rolling trains having a reversing stand, particularly operating with several passes.

15. The method according to claim 1, comprising using the method for rolling endless slabs.

16. The method according to claim 1, comprising using the method for rolling individual slabs.

* * * * *